US010370134B2

(12) United States Patent
Le Rigoleur

(10) Patent No.: US 10,370,134 B2
(45) **Date of Patent: *Aug. 6, 2019**

(54) HAND-HELD HANDLE DISPENSER

(71) Applicant: Neopost Technologies, Bagneux (FR)

(72) Inventor: Yann Le Rigoleur, Antony (FR)

(73) Assignee: Neopost Technologies, Bagneux (FR)

( * ) Notice: Subject to any disclaimer, the term of this patent is extended or adjusted under 35 U.S.C. 154(b) by 24 days.

This patent is subject to a terminal disclaimer.

(21) Appl. No.: 15/542,897

(22) PCT Filed: Jan. 21, 2016

(86) PCT No.: PCT/EP2016/051263

§ 371 (c)(1),
(2) Date: Jul. 11, 2017

(87) PCT Pub. No.: WO2016/120152

PCT Pub. Date: Aug. 4, 2016

(65) Prior Publication Data

US 2018/0002050 A1 Jan. 4, 2018

(30) Foreign Application Priority Data

Jan. 29, 2015 (EP) ..... 15305105

(51) Int. Cl.
*B29C 37/00* (2006.01)
*B44C 7/00* (2006.01)
(Continued)

(52) U.S. Cl.
CPC ..... *B65B 51/06* (2013.01); *B65B 51/067* (2013.01); *B65D 5/46016* (2013.01);
(Continued)

(58) Field of Classification Search
CPC ..... C09J 7/0207; C09J 7/02; B29C 63/024; B29C 63/02; B29C 65/5042; B29C 65/78;
(Continued)

(56) References Cited

U.S. PATENT DOCUMENTS 3,031,359 A 4/1962 Blank et al.
4,028,865 A 6/1977 Loveland et al.
(Continued)

FOREIGN PATENT DOCUMENTS

EP 0 628 483 A1 12/1994
EP 2 851 360 A1 8/2004
(Continued)

OTHER PUBLICATIONS

European Search Report, dated Jun. 20. 2014, for European Application No. 14 29 0016, 2 pages.
(Continued)

*Primary Examiner* — Alex B Efta
(74) *Attorney, Agent, or Firm* — Cozen O'Connor

(57) ABSTRACT

A hand-held handle dispenser comprising: a main frame having a handle, an adhesive tape roll provided at a rear side of the main frame for delivering an adhesive tape, an application element provided at the front side of the main frame for applying the adhesive tape on a parcel and a cutting blade for cutting the adhesive tape, a cartridge for storing an insert strip roll and transport and affixing elements for conveying the insert strip from the cartridge to the application element and affixing it against the adhesive tape to form a handle.

16 Claims, 4 Drawing Sheets

(51) Int. Cl.

| | |
|---|---|
| ***B65B 29/04*** | (2006.01) |
| ***B65B 61/00*** | (2006.01) |
| ***B65B 51/06*** | (2006.01) |
| ***B65H 35/00*** | (2006.01) |
| ***B65H 37/04*** | (2006.01) |
| ***B65D 5/46*** | (2006.01) |

(52) U.S. Cl.
CPC ..... *B65H 35/002* (2013.01); *B65H 35/004* (2013.01); *B65H 35/008* (2013.01); *B65H 37/04* (2013.01); *Y10T 156/10* (2015.01); *Y10T 156/1062* (2015.01); *Y10T 156/1348* (2015.01)

(58) Field of Classification Search
CPC ..... B65H 35/0033; B65H 35/004; B65H 2601/326; B65H 2701/32; B65H 37/04; B65H 37/05
USPC ..... 156/577, 71, 247, 523, 574
See application file for complete search history.

(56) References Cited

U.S. PATENT DOCUMENTS

| | | | | |
|---|---|---|---|---|
| 4,836,352 | A | 6/1989 | Tateno et al. | |
| 4,869,769 | A * | 9/1989 | DiRusso, Jr. | B65B 51/067 156/269 |
| 5,079,900 | A | 1/1992 | Pinckney et al. | |
| 5,081,817 | A * | 1/1992 | Nesbitt | B65B 61/14 53/134.1 |
| 5,145,108 | A * | 9/1992 | Pinckney | B65B 61/14 229/117.23 |
| 6,159,328 | A | 12/2000 | Gaikoski et al. | |
| 6,234,230 | B1 | 5/2001 | Petitjean | |
| 6,323,782 | B1 | 11/2001 | Stephens et al. | |
| 6,895,241 | B2 | 5/2005 | Hara | |
| 9,868,556 | B2 | 1/2018 | Le Rigoleur | |
| 2002/0080030 | A1 | 6/2002 | Inomata | |
| 2003/0138147 | A1 | 7/2003 | Ongkojoyo | |
| 2004/0076544 | A1 | 4/2004 | Dao | |
| 2006/0043298 | A1 | 3/2006 | Kawase et al. | |
| 2006/0098842 | A1 | 5/2006 | Levine | |
| 2006/0152339 | A1 | 7/2006 | Mercier et al. | |
| 2007/0145973 | A1 | 6/2007 | Bertozzi et al. | |
| 2008/0135179 | A1 | 6/2008 | Bedard | |
| 2009/0084504 | A1 * | 4/2009 | Lam | B65B 51/067 156/538 |
| 2013/0048218 | A1 | 2/2013 | Lam | |
| 2013/0119129 | A1 | 5/2013 | Amdahl et al. | |
| 2013/0248425 | A1 | 9/2013 | Kunnen | |
| 2015/0112887 | A1 | 4/2015 | Camp | |
| 2015/0193732 | A1 | 7/2015 | Bouzit-Benbernou | |
| 2015/0217890 | A1 | 8/2015 | Le Rigoleur | |

FOREIGN PATENT DOCUMENTS

| | | | |
|---|---|---|---|
| EP | 2 902 352 | A1 | 8/2015 |
| WO | 88/03897 | A1 | 6/1988 |
| WO | 2004/064581 | A1 | 8/2004 |
| WO | 2013/170316 | A1 | 11/2013 |

OTHER PUBLICATIONS

International Search Report, dated Apr. 29, 2016, for International Application No. PCT/EP2015/066581, 3 pages.
Written Opinion of the International Searching Authority, dated Apr. 29, 2016, for International Application No. PCT/EP2015/066581, 5 pages.
European Search Report, dated Mar. 17, 2014, for European Application No. 14 30 5012, 2 pages.
International Search Report, dated Apr. 5, 2016, for International Application No. PCT/EP2016/051263, 3 pages.
Written Opinion of the International Searching Authority, dated Apr. 5, 2016, for International Application No. PCT/EP2016/051263, 5 pages.

* cited by examiner

HAND-HELD HANDLE DISPENSER

FIELD OF THE INVENTION

The present invention relates to the sealing of packages, cartons or parcels, and more particularly to a hand-held handle dispenser for forming a handle for carrying these packages.

PRIOR ART

Current hand-held adhesive tape dispensers commonly used for parcel wrapping and closure, do not provide the ability to the user to add a handle to the parcel being closed. To add a handle to the parcel, a user has to place an "external" pre-manufactured handle, or some other "external" ad-hoc handle.

Such a solution requires different pre-manufactured handle models to fit with different parcel sizes. This creates logistics and storage difficulties, in addition to the second separate step in affixing the pre-manufactured handle following on the wrapping and closing of the parcel.

Another solution is to use a specific box with prepositioned holes made as handles. Such a solution suffers drawbacks. Indeed, customers often prefer to avoid holes in the package to secure the integrity of the content and so that the interior of the parcel cannot be seen. Moreover, the creation of these holes is an additional cost and may be the cause of a deterioration of the parcel.

OBJECT AND DEFINITION OF THE INVENTION

The object of the invention consists therefore in overcoming the above drawbacks. Another object is to give the user the ability to make handles of various lengths depending on the parcel size and shape.

These objects are achieved by providing a handle distributor incorporated in a hand-held adhesive tape dispenser to constitute a hand-held handle dispenser for affixing both the tapes and the handles.

By locating the handle distributor on the hand-held adhesive tape dispenser, there is no need to search for and choose an "external" handle from a selection of "external" pre-manufactured handles of different sizes. The handle is added to a fully closed parcel without the need for holes/openings in the parcel and it reduces significantly the cost of using such external pre-manufactured handle. Moreover, the user can place the handle(s) where it is most appropriate with regards to the parcel and its contents.

One particular advantage of the invention is to ensure during the affixing of the insert strip onto the adhesive tape that the translation speeds of the adhesive tape and of the insert strip are identical so as to avoid any crinkling of the insert strip, which may eventually result in jamming the dispenser.

To this end, the invention provides a hand-held handle dispenser comprising: a main frame having a handle, an adhesive tape roll provided at a rear side of the main frame for delivering an adhesive tape, an application element provided at the front side of the main frame for applying the adhesive tape on a parcel and a cutting blade for cutting the adhesive tape, a cartridge for storing an insert strip roll and transport and affixing elements for conveying the insert strip from said cartridge to said application element and affixing it against the adhesive tape to form a handle, characterized in that said transport and affixing elements comprise a pulling roller continuously in contact with the insert strip for pulling the insert strip towards the adhesive surface of the adhesive tape when the pulling roller enters in contact with the tape roll, which then drives the rotation of the pulling roller.

According to a feature of the invention, the insert strip roll cartridge is mobile in rotation around an axis and the pulling roller enters in contact with the tape roll when the insert strip roll cartridge is pushed upward by the user.

Preferably, the pulling roller is made of material with a high friction coefficient.

Advantageously, the insert strip roll is formed by a thin strip of paper approximately 45 mm wide with a non-printed side coated by a thin film of plastic or a thin film of foam of same dimensions.

According to a feature of the invention, the hand-held handle dispenser further comprises a trigger acting against a spring mechanism for stopping the dispensing from said insert strip roll by cutting the insert strip and a presser acting on a knife for cutting of an insert strip of a determined length and thus stopping the dispensing from said insert strip roll.

In an alternative embodiment, the insert strip roll includes perforated separating lines, which are regularly spaced along the insert strip of the roll at a distance that is equal or slightly less than the distance between the blocking point for the dispensing from the insert strip roll and the point of contact of said insert strip roll with the adhesive tape.

Preferably, the hand-held handle dispenser further comprises a presser for cutting of an insert strip of determined length by blocking the dispensing of said insert strip roll.

The invention also concerns a method for dispensing a handle on a parcel with the above hand-held handle dispenser comprising the following steps:

- affixing an adhesive tape delivered from an adhesive tape roll provided at a rear end of a main frame of the hand-held dispenser onto the parcel to fasten a first side of the handle onto the parcel,
- by the rotation of a pulling roller continuously in contact with said insert strip, dispensing said insert strip from an insert strip roll cartridge towards the adhesive surface of the adhesive tape until automatically affixing said insert strip onto said adhesive tape,
- continuing the automatic affixing said insert strip onto said adhesive tape by pulling said adhesive tape out of the hand-held tape dispenser,
- stopping the affixing of said insert strip, and
- resuming the affixing of said adhesive tape onto the parcel to fasten the second side of said handle onto the parcel.

In a particular embodiment, when the insert strip is dispensed from the insert strip roll cartridge, stopping the affixing of said insert strip is made by cutting said insert strip roll via a presser blocking or acting on a knife for stopping the dispensing of said insert strip roll.

Advantageously, the affixing of the adhesive tape on the parcel is made onto a determined length of a first adhesive tape already used for closing the parcel.

BRIEF DESCRIPTION OF THE DRAWINGS

Other aspects, features and advantages of the present teachings will become clearer to those ordinary skilled in the art upon review of the following description of a specific preferred embodiment of the invention in conjunction with the accompanying drawings where.

DETAILED DESCRIPTION OF EMBODIMENTS

The hand-held handle dispenser according to the invention not only operates as a hand held adhesive tape dispenser commonly used for parcel wrapping and closure, but also provides the ability for the user to add a handle to the parcel being closed. To this end, it is proposed to create, within a standard adhesive tape, which is regularly used for closing parcels and provided by a hand held adhesive tape dispenser, a non-adhesive zone within the length of this adhesive tape by attaching on the adhesive part of the tape an insert strip provided from a handle distributor incorporated in this hand-held adhesive tape dispenser.

So, the handle is constituted of three parts:

- a first side of the handle constituted of adhesive tape for adhering upstream onto the parcel and coming from the hand held adhesive tape dispenser,
- a middle non-adhesive zone created by affixing the insert strip onto the adhesive tape, and
- a second side of the handle constituted of adhesive tape for adhering downstream onto the parcel and coming from the hand held adhesive tape dispenser. Therefore, the user can use the same hand-held tool for both affixing the tape for closing the parcel and for affixing the handle in a seamless operation.

Figure 1:
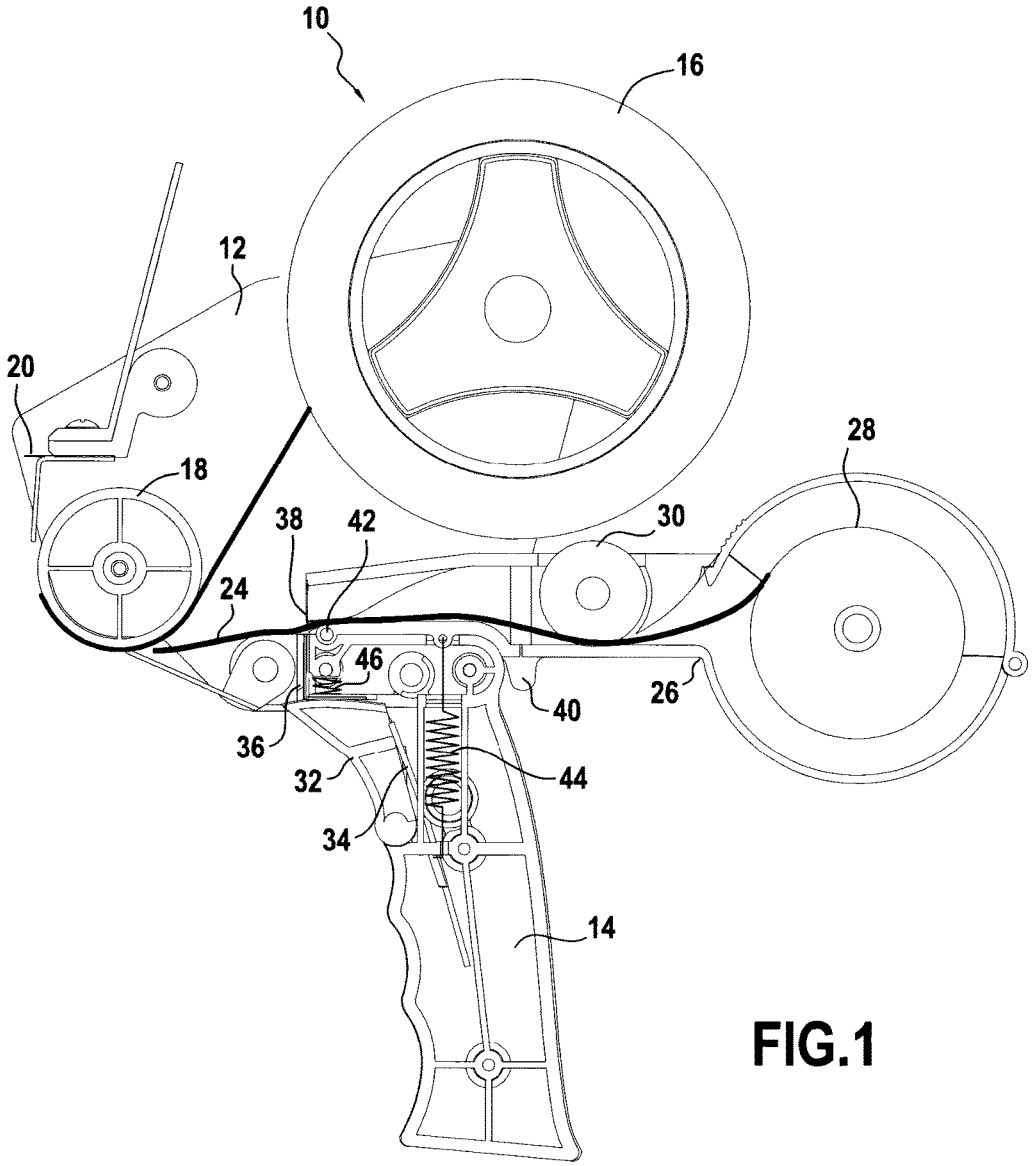
FIG. 1 shows an embodiment of a hand-held handle dispenser according to the invention in which the insert strip is dispensed from a roll via a pulling roller.

FIG. 1 illustrates an embodiment of a hand-held handle dispenser according to the invention.

As a standard hand-held adhesive tape dispenser, the hand-held handle dispenser 10 of the invention essentially comprises a main frame 12 having a handle 14, an adhesive tape roll 16 provided at a rear side of the main frame, an application element such as a roller 18 provided at the front side of the main frame and a cutting blade 20.

According to the invention, such dispenser further includes elements for dispensing and affixing the insert strip 24 and elements for stopping the affixing of the insert strip.

The elements for dispensing and affixing the insert strip comprise an insert strip roll cartridge 26 for storing a strip roll 28 and guiding the insert strip 24 from the storing area to the affixing area, and transport means such as a pulling roller 30 for conveying the insert strip 24 from the cartridge storing area to the application roller 18. The insert strip 24 is dispensed from the roll 28 stored in the insert strip roll cartridge 26, thus providing a continuous insert strip. The width of the insert strip roll is approximately the same as the adhesive tape, which it is to be used with. The inner width of the insert strip roll cartridge 26 is slightly larger than the insert strip width so that it can guide the insert strip from the cartridge storing area to the application roller 18, and also so that it does block the conveying of the insert strip.

The elements for stopping the affixing of the insert strip comprise a trigger 32 acting against a spring mechanism 34, a presser 36 and a knife 38. The action of the trigger 32, when operated by the user of the hand-held tape dispenser, results in the cutting the continuous strip dispensed from the roll. The presser 34 actionable by the trigger is used to raise the insert strip roll towards a knife 38 in order to cut the insert strip roll. Such a roll allows a provision for a large reserve for dispensing insert strips. It also allows the user to define the exact length that he wishes for the handle.

Preferably, the insert strips can be obtained from a roll of paper measuring approximately 45 mm wide. A 45 mm width corresponds to standard adhesive tape width. The side of the roll, which adheres to the tape, can be printed with some advertising information. This advertising information could be seen through the tape when this one is transparent or partially transparent. Another possibility is to use a thin film of plastic or a thin film of foam approximately 45 mm wide instead of a roll of paper.

While the user is in the process of affixing the adhesive tape onto a parcel, the dispensing of the insert strip operates as follows. At first, the user pushes the insert strip roll cartridge 26 upward. The bottom surface of the strip roll cartridge 26 includes a rib 40. This rib serves as a reference body so that the user thumb can easily stop and rest on it when the user decides to push upward the strip roll cartridge 26. The insert strip roll cartridge 26 is maintained by and is mobile in rotation around the axis 42. When the user pushes the insert strip roll cartridge 26 upward, the insert strip roll cartridge 26 rotates around the axis 42 and the pulling roller 30 enters in contact with the tape roll 16. As the user continues pulling the adhesive tape while affixing it onto the parcel, the rotation of the tape roll 16 makes the pulling roller 30 rotate. As the pulling roller 30 rotates, it pulls the insert strip 24 towards the adhesive surface of the adhesive tape and makes the insert strip roll 28 rotate. Thus the insert strip 24 is transported towards the adhesive tape. During its transportation, the insert strip 24 is guided by the inner sides of the strip roll cartridge 26. The action of advancing an insert strip towards the adhesive tape results in adhering the insert strip to the adhesive tape and therefore in creating on the adhesive tape of a zone whereby the adhesive tape is no longer capable of adhering to the parcel, thus creating a zone free of adhesive to be used as a "handle". This non-adherent zone also means that the "handle" does not adhere to the user's hand while carrying the parcel. Once affixed onto the adhesive tape, the insert strip 24 is pulled by the adhesive tape itself, as well as being pulled by the pulling roller 30 as long as the user keeps pushing upward the whole roll dispenser. It must be noticed that these two pulling mechanisms are exactly synchronized as they are both resulting from the rotation of the tape roll 16. The rotation of the pulling roller 30 moves the insert strip the same distance as the adhesive tape is moved. Therefore, this movement synchronization avoids any crinkling of the insert strip, which could be due to different translation speeds of the adhesive tape and of the insert strip, and which may eventually result in jamming the dispenser.

Advantageously, the pulling roller 30 is made of material with a high friction coefficient so as to be efficiently driven in rotation by the tape roll 16 on one hand, and so as to efficiently pull the insert strip 24 on the other hand. A preferred material for the pulling roller 30 is rubber. Preferably, the contact surface of the pulling roller 30 is profiled in order to increase its friction efficiency. A preferred surface profile for the pulling roller 30 is made of grooves with a triangular profile or a square profile.

Once the dispensing of the insert strip has been initiated and the insert strip has started being affixed onto the adhesive tape, the user can stop pushing upward the insert strip roll cartridge 26. The insert strip roll cartridge 26 returns to its rest down position via a spring mechanism 44 for example. Then, the insert strip 24 is pulled only by the adhesive tape itself: the pulling roller 30 does not rotate and does not pull the insert strip 24 anymore. However, because of the synchronization of the translation speeds of the adhesive tape and of the insert strip described above, the user may maintain the insert strip roll cartridge 26 pushed upward as long as he desires without any risk of crinkling the insert strip.

Once the adequate length of handle is obtained, the dispensing of the insert strip needs to be stopped by cutting the insert strip roll. The user pushes on the trigger 32 to operate this cut. The action by the user on the trigger 32 forces the presser 36 to rise. This lifts the insert strip roll towards the knife 38, thus resulting in cutting the insert strip roll. Once the insert strip roll is cut, the user can resume affixing the adhesive tape on the parcel to fasten the second side of the handle onto the parcel.

When the user releases the trigger 32, the trigger automatically returns to its rest position via the spring mechanism 34. The presser 36 returns to its rest down position via a spring mechanism 46 too for example. Thus, the hand-held handle dispenser system is back in the initial stage and a new handle can be initiated by the user at his will.

In a variant for stopping the affixing of the insert strip, the insert strip roll includes perforated separating lines. In this case, the cutting mechanism is replaced by a system enabling the tearing of the roll at the user's will. When the user decides to end the non-adhesive zone of the handle, he activates the blockage of dispensing of the insert strip roll. Once the insert strip roll is blocked, the perforated separating line situated between the blocking point and the point of contact with the adhesive tape will be torn by the pulling force resulting from the tape dispensing action.

Preferably, the distance between the perforated separating lines must be equal or slightly less than the distance between the blocking point of the insert strip roll and the point of contact with the adhesive tape with the insert strip roll. Thus, only one perforated separating line shall be positioned between the blocking point of the insert strip roll and the point of contact with the adhesive tape with the insert strip roll. The tearing of the insert trip shall take place in a controlled manner, resulting in a determined handle length.

Regardless of the embodiment, the operation for dispensing a handle with the hand-held handle dispenser of the invention can be summarized as follows with reference to FIGS. 2A to 2F.

Figure 2B:
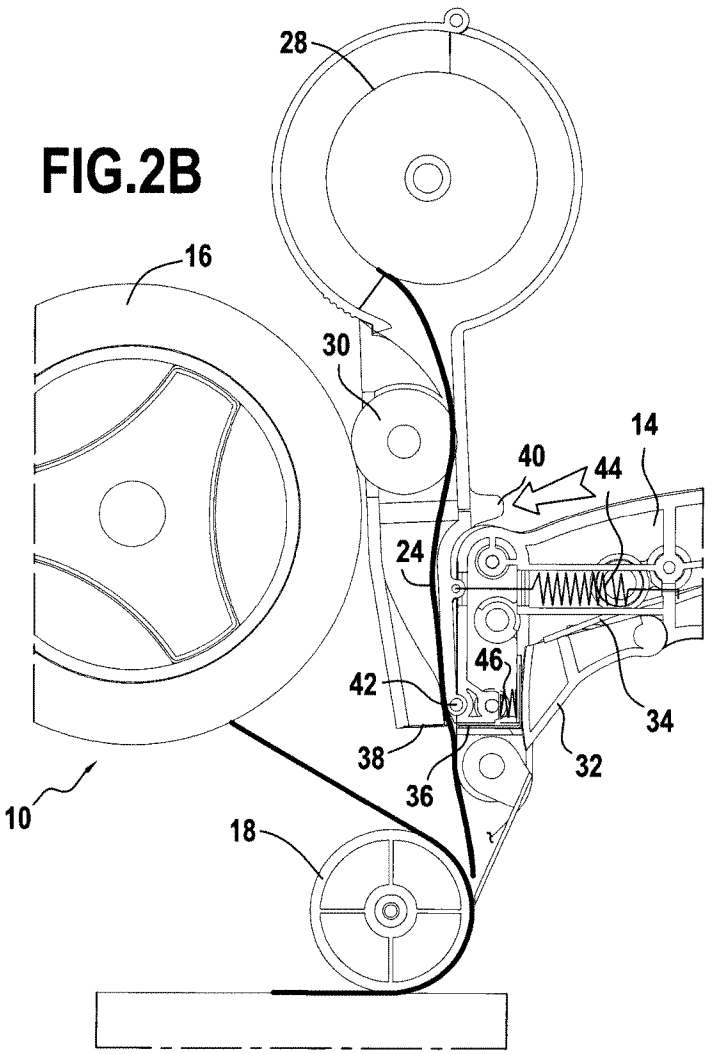
FIGS. 2A to 2F illustrate different tape and strip positions during the operating of the hand-held handle dispenser of the invention.
Figure 2A:
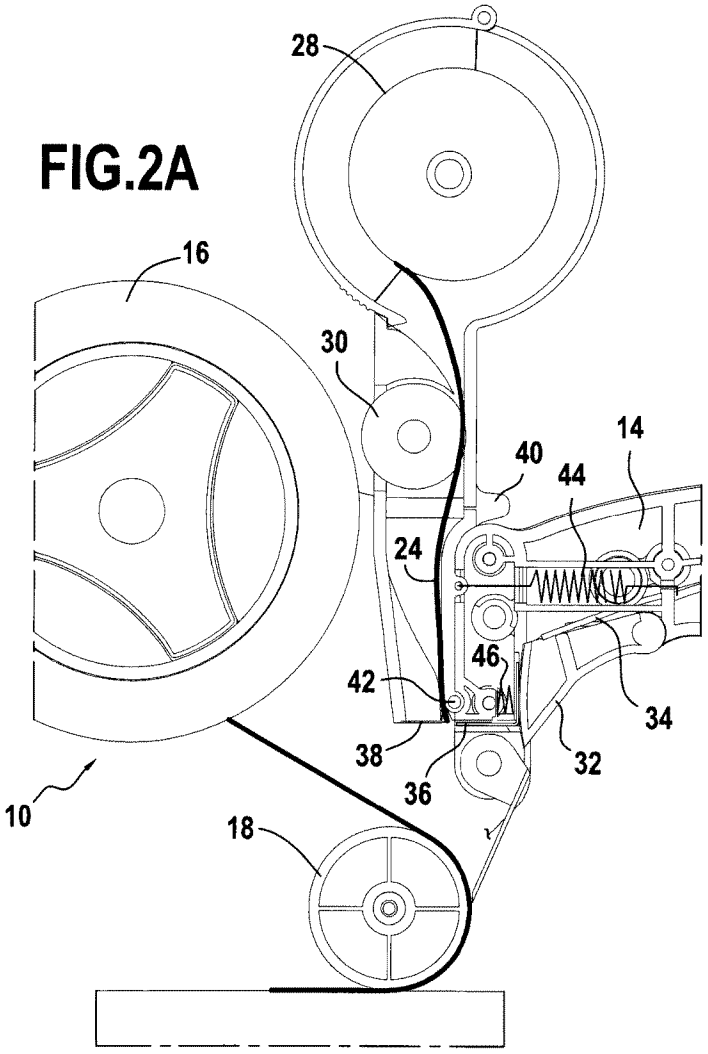
Figure 2D:
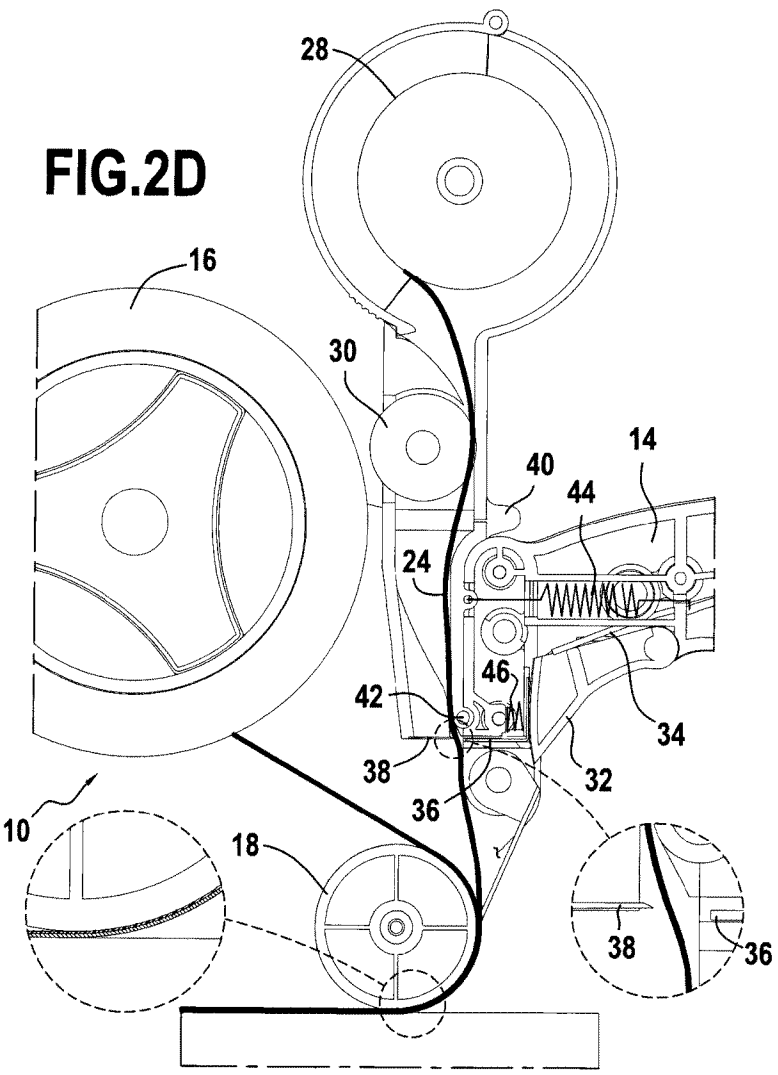
Figure 2C:
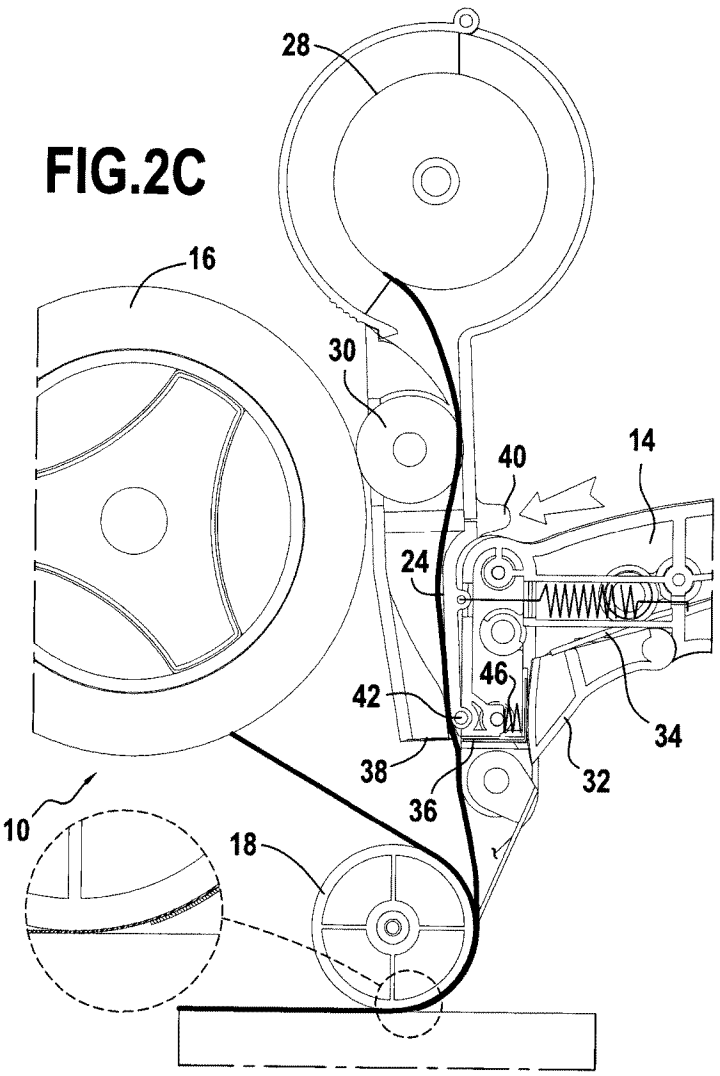
Figure 2F:
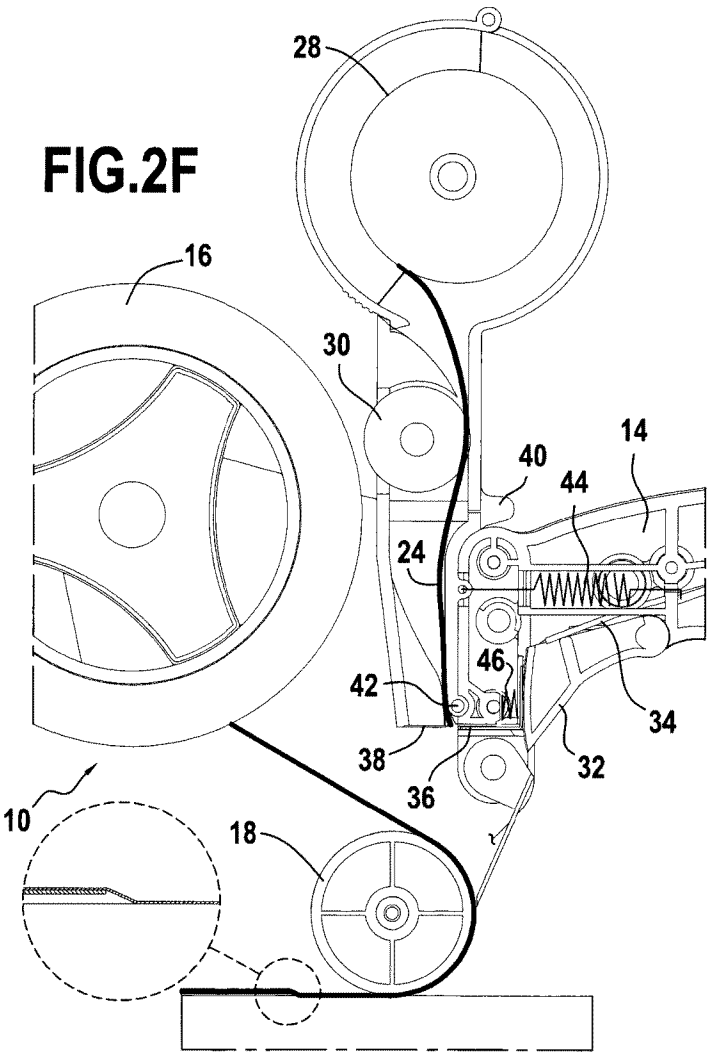
Figure 2E:
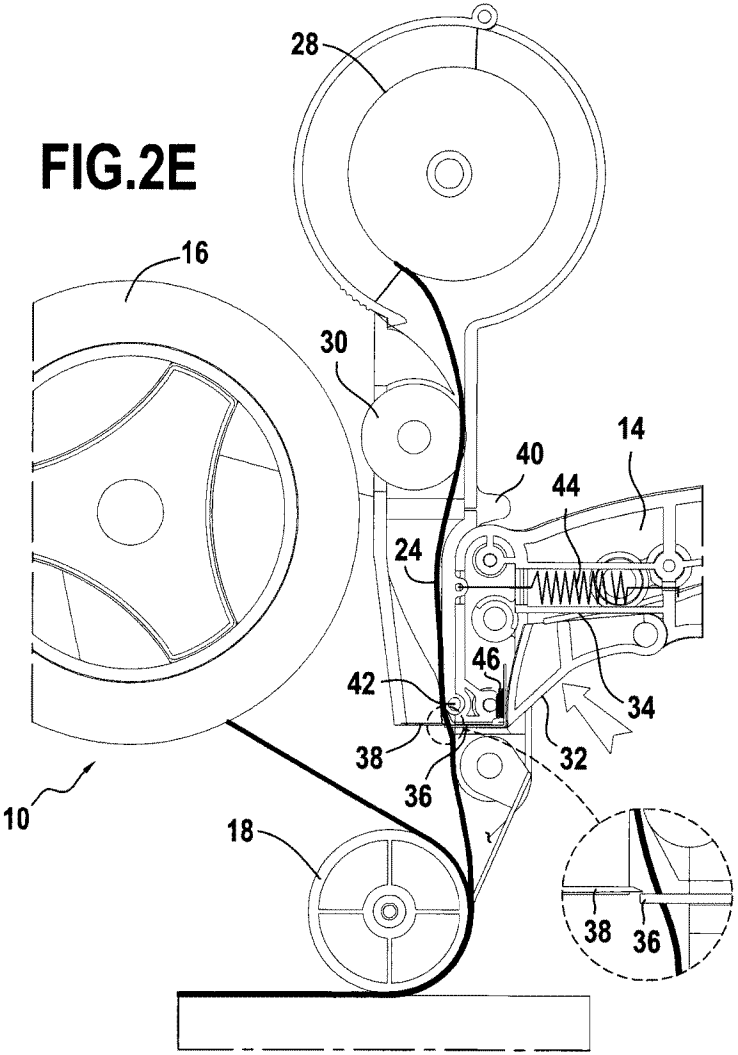

Firstly the parcel must first be closed in a standard way with a first adhesive tape delivered from the adhesive tape roll provided at the rear end of the main frame of the hand-held dispenser and then the steps for adding the handle take place and comprise:

- affixing a second adhesive tape on the parcel to fasten the first side of the handle onto the parcel, preferably onto the first adhesive tape already used for closing the parcel (FIG. 2A),
- by the rotation of the pulling roller continuously in contact with the insert strip, dispensing the insert strip from the insert strip roll cartridge towards the adhesive surface of the second adhesive tape until automatically affixing the insert strip onto the second adhesive tape (FIG. 2B),
- continuing the automatic affixing the insert strip onto the second adhesive tape by pulling the adhesive tape out of the hand-held tape dispenser (FIG. 2C and FIG. 2D),
- stopping the affixing of the insert strip (FIG. 2E), and
- resuming the affixing the second adhesive tape on the parcel to fasten the second side of the handle onto the parcel, preferably onto the adhesive tape already used for closing the parcel (FIG. 2F).

Depending on the embodiment, stopping the affixing of the insert strip is made by tearing the insert strip roll via the presser 36 blocking the insert strip roll or by cutting the insert strip roll via acting on the knife 38.

It is recommended that the non-adhering part of the handle be preceded and terminated by a length of adhesive tape measuring at least 15 cm, and adhering to both opposite sides of the parcel. The non-adhering part of the handle should start on the top edge of the parcel and should reach the opposite edge of the parcel. Furthermore, for better resistance, it is recommended that the adhesive parts of the handle adhere onto the adhesive tape already used for closing the parcel.

Large parcels may require more than one handle. Two handles can be placed on either side of the parcel and perpendicular to the longest edge. This enables the parcel to be carried by one or two persons depending on its size and weight.

It must be noted that the different elements for dispensing the insert strip can be provided as handle distributor kits for upgrading standard adhesive tape dispensers in the field or for producing brand new combo tape and handle dispensers, and benefiting from the experience curve and economies of scale of current adhesive tape dispenser. Alternatively, the handle distributor can be integrated onto adhesive tape dispenser currently distributed on the market place allowing the following possibilities such as integrating the handle distributor within the production line of adhesive tape dispenser.

The invention claimed is:

1. A hand-held handle dispenser comprising: a main frame having a handle, an adhesive tape roll provided at a rear side of the main frame for delivering an adhesive tape, an application element provided at the front side of the main frame for applying the adhesive tape on a parcel and a cutting blade for cutting the adhesive tape, a cartridge for storing an insert strip roll and transport and affixing elements for conveying the insert strip from said cartridge to said application element and affixing it against the adhesive tape to form a handle, wherein said transport and affixing elements comprise a pulling roller continuously in contact with the insert strip for pulling the insert strip towards the adhesive surface of the adhesive tape when the pulling roller enters in contact with the tape roll, which then drives the rotation of the pulling roller.

2. The hand-held handle dispenser according to claim 1, wherein the insert strip roll cartridge is mobile in rotation around an axis and in that the pulling roller enters in contact with the tape roll when the insert strip roll cartridge is pushed upward by the user.

3. The hand-held handle dispenser according to claim 1, wherein said pulling roller is made of material with a friction coefficient high enough so that the pulling roller is driven in rotation by the tape roll and the insert strip is pulled by the pulling roller.

4. The hand-held handle dispenser according to claim 1, wherein said insert strip roll is formed by a strip of paper approximately 45 mm wide with a non-printed side coated by a film of plastic or a film of foam of same dimensions.

5. The hand-held handle dispenser according to claim 1, further comprising a trigger acting against a spring mechanism for stopping the dispensing from said insert strip roll by cutting the insert strip.

6. The hand-held handle dispenser according to claim 5, further comprising a presser acting on a knife for cutting of an insert strip of a determined length and thus stopping the dispensing from said insert strip roll.

7. The hand-held handle dispenser according to claim 5, wherein said insert strip roll includes perforated separating lines, which are regularly spaced along the insert strip of the roll at a distance that is equal or less than the distance between the blocking point for the dispensing from the insert strip roll and a point of contact of said insert strip roll with the adhesive tape.

8. The hand-held handle dispenser according to claim 7, further comprising a presser for cutting of an insert strip of a determined length by blocking the dispensing of said insert strip roll.

9. A hand-held handle dispenser comprising:

a hand-held portable main frame having:

a front side;

a rear side;

a handle graspable by a hand of a user during operation, the portable hand-held handle dispenser manually moveable by the user during operation;

a tape roll holder to hold an adhesive tape roll, the tape roll holder provided at the rear side of the main frame to deliver a course of adhesive tape from an adhesive tape roll when the adhesive tape roll is held by the tape roll holder;

a cartridge to hold an insert strip roll comprising a plurality of insert strips;

an applicator positioned at the front side of the main frame to apply the course of adhesive tape on a parcel during operation;

a cutting blade positioned to selective cut the course of adhesive tape, and a pulling roller continuously in contact with the insert strip roll and rotatable to pull at least a leading one of the insert strips of the insert strip roll towards an adhesive surface of the course of adhesive tape when the pulling roller enters in contact with the adhesive tape roll, the dispensing of the course of adhesive tape which then drives the rotation of the pulling roller in synchronization therewith.

10. The hand-held handle dispenser according to claim 9, wherein the insert strip roll cartridge is mobile in rotation around an axis and the pulling roller enters in contact with the course of the adhesive tape when the insert strip roll cartridge is pushed upward.

11. The hand-held handle dispenser according to claim 9, wherein the pulling roller is made of material with a friction coefficient high enough so that the pulling roller is driven in rotation by the tape roll and the insert strip is pulled by the pulling roller.

12. The hand-held handle dispenser according to claim 9, further comprising the insert strip roll, the insert strip roll formed by a strip of paper approximately 45 mm wide with a non-printed side coated by a film of plastic or a film of foam of same dimensions.

13. The hand-held handle dispenser according to claim 12, further comprising:

a knife spaced relatively upstream of the applicator with respect to a direction in which the insert strips of the insert strip roll move toward the applicator;

a trigger operable to selectively move a portion of the insert strip roll into contact with the knife to selectively cut the portion of the insert strip roll; and a spring mechanism that biases the trigger away from a position in which the insert strip roll is in contact with the knife.

14. The hand-held handle dispenser according to claim 13, further comprising a presser coupled to trigger to move in response to actuation of the trigger and to physically engage and move the portion of the insert strip roll into cutting engagement with the knife to cut the portion of the insert strip roll to a determined length, and thereby stop the further dispensing from the insert strip roll.

15. The hand-held handle dispenser according to claim 13, wherein said insert strip roll includes perforated separating lines, which are regularly spaced along the insert strip of the roll at a distance that is equal or less than the distance between the blocking point for the dispensing from the insert strip roll and a point of contact of said insert strip roll with the course of adhesive tape.

16. The hand-held handle dispenser according to claim 9, further comprising a presser selectively positionable to block the further dispensing of said insert strip roll.

* * * * *